US008088087B1

(12) United States Patent
Lunter et al.

(10) Patent No.: US 8,088,087 B1
(45) Date of Patent: Jan. 3, 2012

(54) DRY HYDRO-THERAPY BODY MASSAGE APPARATUS WITH LOW PROFILE ENCLOSURE PANELS

(76) Inventors: Paul J. Lunter, Palm Harbor, FL (US); Timothy S. Elliott, Pinellas Park, FL (US)

( * ) Notice: Subject to any disclaimer, the term of this patent is extended or adjusted under 35 U.S.C. 154(b) by 917 days.

(21) Appl. No.: 12/150,638

(22) Filed: Apr. 30, 2008

(51) Int. Cl.
*A61H 7/00* (2006.01)

(52) U.S. Cl. ..... 601/148; 601/149

(58) Field of Classification Search ..... 601/155–158, 601/160, 148–149; 4/597
See application file for complete search history.

(56) References Cited

U.S. PATENT DOCUMENTS

| | | | | |
|---|---|---|---|---|
| 4,635,620 | A | 1/1987 | Ricchio | 128/64 |
| 4,751,919 | A | 6/1988 | Thomsen | 128/66 |
| 4,757,808 | A | 7/1988 | Effler, Jr. | 128/66 |
| 4,908,016 | A | 3/1990 | Thomsen | 128/66 |
| 4,976,256 | A | 12/1990 | Marlin et al. | 128/64 |
| 5,074,286 | A | 12/1991 | Gillaspie et al. | 128/33 |
| 5,713,834 | A | 2/1998 | Palmer | 601/149 |
| 5,827,206 | A | 10/1998 | Lunter | 601/148 |
| 6,036,663 | A | 3/2000 | Arzt | 601/156 |
| 2008/0271238 | A1 * | 11/2008 | Reeder et al. | 4/597 |
| 2009/0312680 | A1 * | 12/2009 | Lunter et al. | 601/158 |

* cited by examiner

*Primary Examiner* — Michael A. Brown

(57) ABSTRACT

An apparatus for hydro-therapy massage characterized by a low profile enclosure structure surrounding a user support surface at a nominal elevation thereabove. The apparatus comprises a housing structure having an outwardly facing opening, a user support surface covering the opening, and a fluid spray arrangement within the housing structure for imparting a massaging effect through the support surface to a user thereon. The housing structure has a horizontal perimeter flange extending about the opening and a clamp plate affixed in substantially parallel superposed facing relation to the perimeter flange for clamping a continuous edge margin of the user support surface. An enclosure panel has an essentially planar mounting flange affixed in substantially parallel superposed facing relation to the clamp plate and has a skirt portion extending from the mounting flange for enclosing the housing structure.

16 Claims, 3 Drawing Sheets

DRY HYDRO-THERAPY BODY MASSAGE APPARATUS WITH LOW PROFILE ENCLOSURE PANELS

BACKGROUND OF THE INVENTION

The present invention relates generally to apparatus for applying a massaging effect to the body of a user and, more particularly, to enclosure panels for such apparatus having a low profile relative to the operational structure of the apparatus.

Massage is a time-honored and generally effective therapy for muscular injuries, strains and general soreness but, although massage is still recommended by many physicians for such purposes, this therapy has severely limited availability due to a scarcity of trained, qualified masseurs. As a result, many devices and apparatus have been proposed in the past for producing a massage-like manipulation of a user's body by various means, ranging from mechanically or electrically-generated vibrations or pulsations, usually accompanied by heating, to pulsations of pressurized water, applied either is a wet environment such as partially submerging the user's body in a bath device or in a dry environment wherein a fluid spray arrangement is housed in a fluid-tight bed or chair type structure for applying a massaging effect to the user's body without requiring the user to disrobe.

Representative examples of the latter form of apparatus, often commonly referred to as dry hydro-therapy massage, are disclosed in U.S. Pat. Nos. 4,635,620; 4,751,919; 4,757,808; 4,908,016; 4,976,256; 5,074,286; 5,713,834; 5,827,206; and 6,036,663. Such apparatus have met with moderate success, and efforts continue within the relevant industry to expand their acceptance, availability and usefulness.

Such dry hydro-therapy massage apparatus may be embodied in apparatus wherein the user support surface is a generally horizontal bed surface on which the user may lay in a recumbent position or, alternatively, in apparatus wherein the user support surface is a generally inclined seat surface on which the user may sit in an upright or partially reclining seated position. In either case, the structure surrounding the user support surface must provide for sealing of the user support surface to prevent leakage of massage fluid for purposes of operational integrity of the apparatus as well as user comfort and safety. It is commonplace for the surround structure to be heavily built-up and padded for the same reasons of comfort and safety as well as to assist in maintaining the user on the support surface during operation. However, a disadvantage of this built-up surround structure is that users may have greater difficulty in ingress and egress to and from the user support surface over the built-up surround structure.

SUMMARY OF THE INVENTION

It is accordingly an object of the present invention to provide an improved low profile surround structure in dry hydro-therapy body massage apparatus which overcomes the above-described disadvantages of known apparatus.

Briefly summarized, the present invention provides an apparatus for dry hydro-therapy body massage characterized by a low profile structure adjacent a user support surface at a nominal spacing therefrom. The dry hydro-therapy body massage apparatus of the present invention basically comprises a housing structure having an outwardly facing opening, a user support surface covering the opening, and a fluid spray arrangement interiorly within the housing structure for directing a fluid stream at the user support surface for imparting a massaging effect through the support surface to the body of a user thereon. In accordance with the present invention, the housing structure has an essentially planar flange extending adjacent the opening and an essentially planar clamp plate affixed in substantially parallel superposed facing relation to the flange for clamping therebetween of an edge margin of the user support surface, and a covering panel having an essentially planar mounting surface affixed in substantially parallel facing relation to the clamp plate for disposition at a nominal spacing from the user support surface.

The present invention may be embodied in many different apparatus for dry hydro-therapy body massage. For example, the invention is readily adapted to apparatus wherein the user support surface is a generally horizontal bed surface on which the user may lay in a recumbent position. Alternatively, the invention is equally adapted for use in apparatus wherein the user support surface is a generally inclined seat surface on which the user may sit in an upright or partially reclining seated position.

Preferably, the flange of the housing structure comprises a recess containing a seal element held therein by the clamping plate for sealably clamping the edge margin of the user support surface within the recess. A safety net may be secured to the housing structure immediately adjacent an inward side of the user support surface for weight bearing support of a user on the user support surface. A fastener arrangement, such as a bolt assembly or an equivalent fastener assembly, may be provided for physically securing the clamping plate to the flange of the housing structure. A hook and loop fastener assembly may be provided for affixing the mounting flange of the enclosure panel to the clamping plate.

In a preferred embodiment of the dry hydro-therapy body massage apparatus, the flange of the housing structure preferably is oriented horizontally and extends uninterrupted about the entire perimeter of the opening and the planar clamp plate clamps against the perimeter flange a continuous edge margin of the user support surface to sealably cover the opening. An enclosure panel having an essentially planar mounting flange is affixed in substantially parallel superposed facing relation to the clamp plate and has a skirt portion extending from the mounting flange for outwardly enclosing the housing structure. In this manner, the mounting flange of the enclosure panel is disposed at a nominal elevation above the user support surface to form a low profile surround thereabout. By way of example but without limitation, the elevation of the mounting flange above the user support surface is preferably on the order of approximately 0.75 inch or less.

DESCRIPTION OF THE PREFERRED EMBODIMENT

As will be readily understood by persons skilled in the relevant art, the low profile structure of the present invention is readily adapted to be embodied in many and various differing forms of dry hydro-therapy body massage apparatus. The present invention is described herein as embodied in a representative bed or table form of such apparatus, but only for purposes of providing an exemplary enabling disclosure of the invention and, in particular, the invention is not intended to be limited, and should not be construed as limited, to application or embodiment in such apparatus nor any other particular structure or type of such apparatus except as defined in the claims appended hereto.

Figure 1:
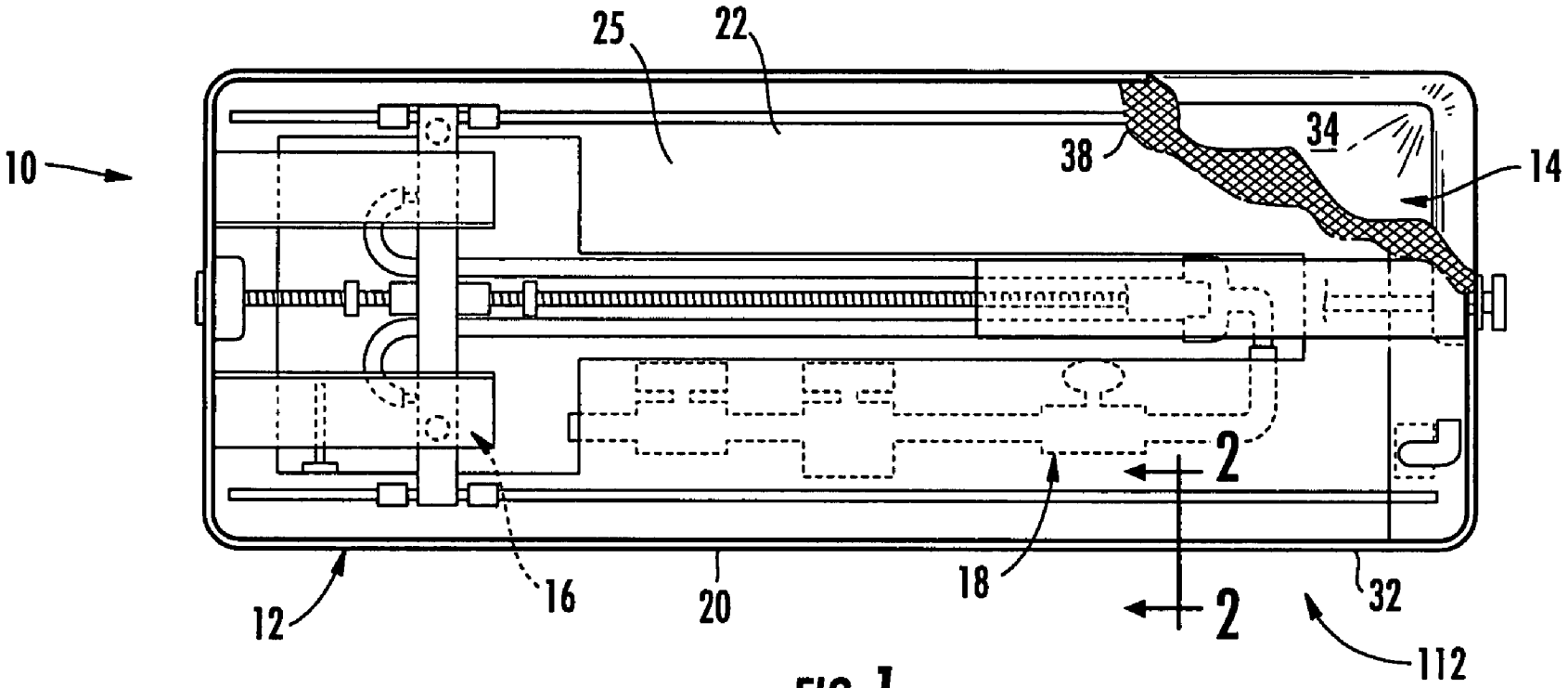
FIG. 1 is a top plan view of a representative form of dry hydro-therapy body massage apparatus of a bed-style wherein a user lies in a recumbent position during use, the apparatus being partially broken away to show the interior components of the apparatus.
Figure 2:
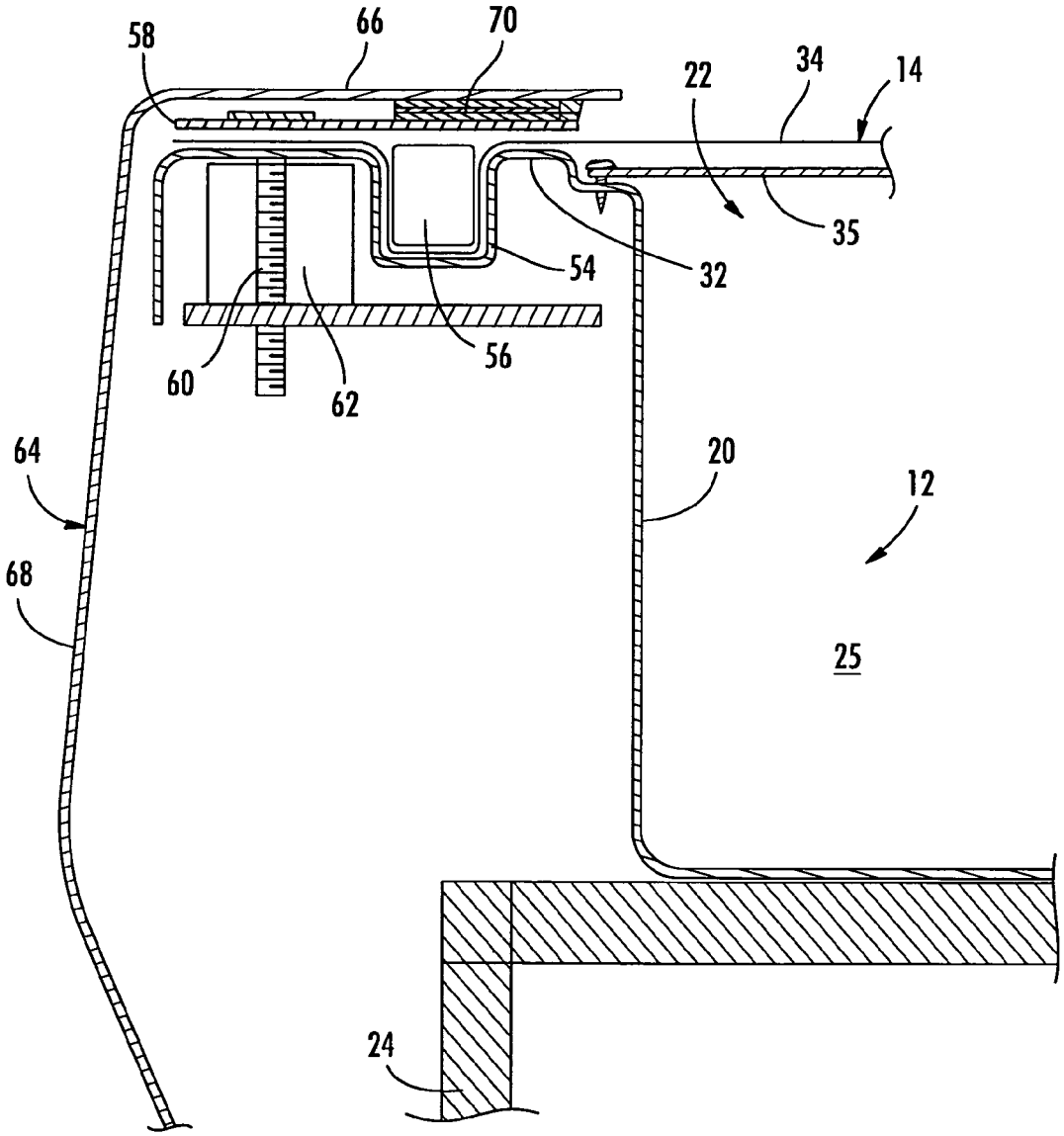
FIG. 2 is a vertical cross-sectional view of the dry hydro-therapy body massage apparatus of FIG. 1, taken along the line 2-2 thereof.

Referring now to the accompanying drawings and initially to FIGS. 1 and 2, a bed-style dry hydro-therapy body massage apparatus of a representative form known in the relevant industry is generally indicated at 10. The body massage apparatus 10 includes a housing structure, generally indicated at 12, and a generally horizontal upwardly facing user support surface 14 on which a user may lay in a recumbent position for massage treatment, as more fully explained hereinafter. A fluid spray arrangement, generally indicated at 16, is disposed within the housing 12 in association with a pressurized fluid supply arrangement, generally indicated at 18, for directing a pressurized fluid emission at the underside of the user support surface 14 to transmit a massaging effect therethrough to the body of a user laying thereon.

The housing structure 12 includes a substantially hollow housing shell 20 generally in the form of a tank or tub of an overall rectangularly parallelepiped configuration closed at its bottom and side walls and substantially open at its top to define an upwardly-facing rectangular opening 22. The housing shell 20 may be fabricated of any suitable watertight, rigid material of appropriate strength which may be formed to the desired configuration herein described, e.g., fiberglass or a like material. The housing shell 20 may include a floor-standing frame 24, e.g., fabricated of metal tubing or the like, to elevate the user support surface 14 at a desired height above the floor while also providing an open area within the frame 24 and beneath the housing shell 20 for enclosure of various operating components of the body massage apparatus 10.

A hollow interior chamber 25 is defined by the housing shell 20, with the lower area of the chamber forming a reservoir for the massage fluid. A perimeter flange 32 projects outwardly from the uppermost extent of the housing shell 20 about the full perimeter thereof for mounting thereto of the user support surface 14, as more fully described hereinafter.

A liquid material is preferred as the fluid medium utilized by the body massage apparatus 10 for supply to and emission from the fluid spray arrangement 16 to produce a massage effect as hereinafter described, water being an optimal liquid in view of its ready availability and generally non-corrosive and non-caustic character. A suitable supply of water, or another appropriate liquid, is stored in the lower reservoir area of the housing shell 20 for continuous circulation through the fluid supply arrangement and the fluid spray arrangement 16, the interior surfaces of the housing 20 being configured to drain the liquid emitted from the fluid spray arrangement 16 into the reservoir area. Of course, as those persons skilled in the art will readily recognize, pressurized air, other gases, and other fluidic materials could also be utilized as the fluid massaging medium without departing from the scope and substance of the present invention and, accordingly, the present invention is not intended to be and should not be construed as limited to the use of water or another liquid massage medium.

The user support surface 14 may be formed of a relatively thin sheet 34 of a waterproof material with a continuous edge margin thereof affixed in watertight relation across the flange 32 bordering the upwardly facing opening 22. The sheet 34 preferably is sufficiently thin that the impact of fluid emitted from the fluid spray arrangement 16 against the underside of the sheet 34 transmits a massaging effect through the sheet 34 to the body of the user. Further, the sheet 34 is preferably of a sufficient flexibility and resiliency to substantially conform to the body of the user for maximum transmission of the massage effect through the sheet 34 to the user. In this manner, the sheet 34 functions in the nature of a waterproof membrane to keep the user dry during operation of the body massage apparatus 10 without noticeably dampening the massaging impact of fluid emitted from the fluid spray arrangement 16. For example, a latex rubber in sheet form, in the range of 20 to 40 mil. thickness, is a suitable material to provide these characteristics for the sheet 34, although various other commercially available rubber and plastic sheeting materials should also provide suitable results.

As a primary means of weight bearing support of the user, an open-mesh netting 38 may be affixed in tensioned condition to the housing shell 20 at the flange 32 horizontally across its opening 22 immediately beneath the sheet 34. The netting 35 should be of sufficient strength to independently support the weight of a user to provide a safety barrier in the event of a rupture or other failure of the sheet 34. At the same time, the open-mesh construction of the netting 35 permits essentially unrestricted transmission of fluid from the fluid spray arrangement 16 through the netting 35 and against the underside of the sheet 34.

The fluid spray arrangement 16 may include any suitable arrangement for emitting the massage fluid under pressure against the underside of the membrane sheet 34. For example, the fluid spray arrangement 16 may comprise an elongate massage head, generally indicated at 44, mounted for traversing travel back-and-forth through substantially the full lengthwise extent of the chamber 25 with the elongate extent of the head 44 oriented transversely across substantially the full widthwise extent of the chamber 25. Alternatively, it is also possible to provide an array of fixed liquid spray nozzles within the housing shell 20. Pressurized fluid is delivered from the fluid supply arrangement 18 to the massage head 44 or other form of spray arrangement in any suitable way, for example, via a motor driven liquid pump (not shown) arranged to draw fluid from the reservoir of the housing shell 20 and to deliver the fluid under pressure to the massage head 44

Figure 3:
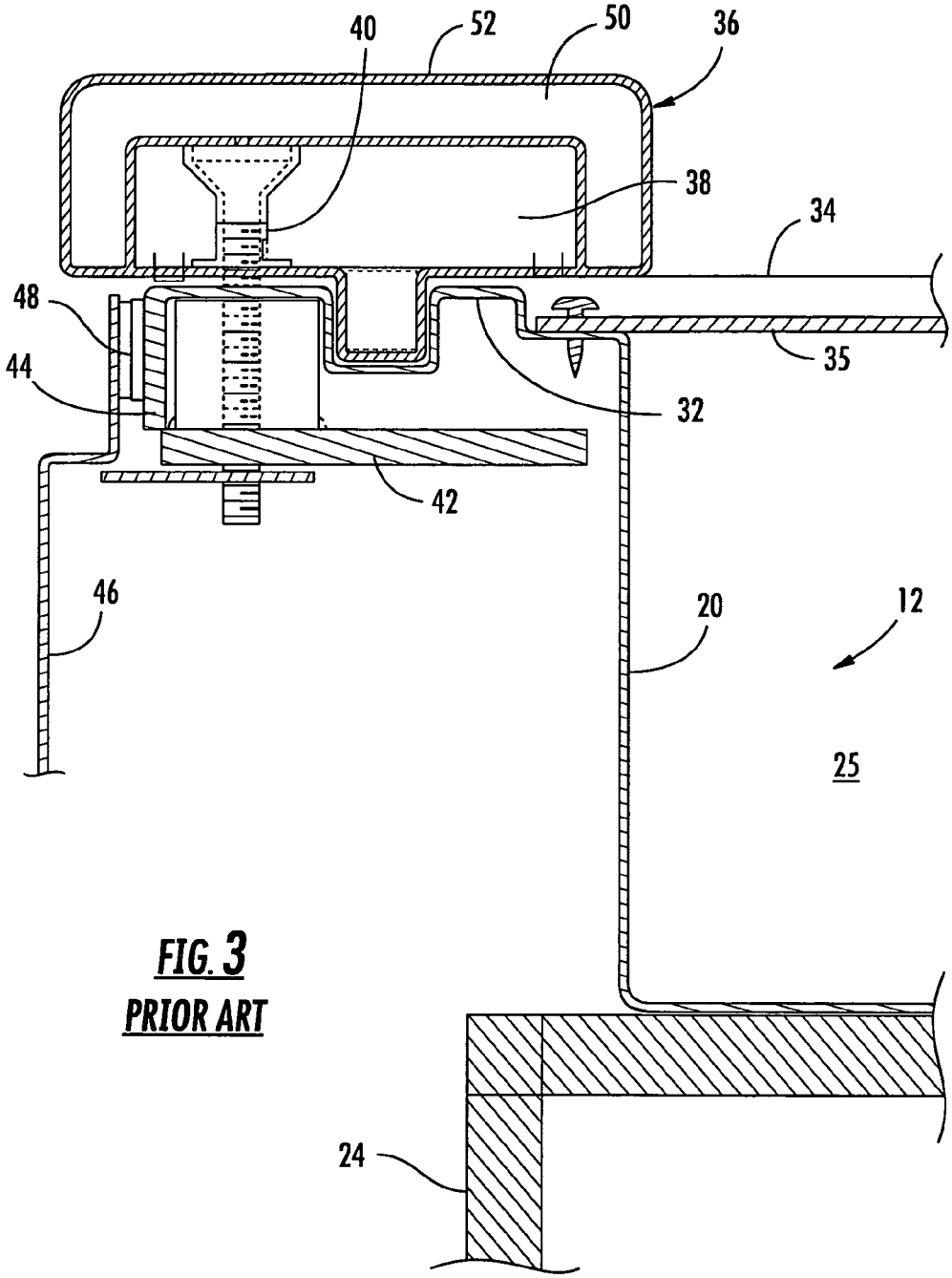
FIG. 3 PRIOR ART
FIG. 3 is a vertical cross-sectional view of a prior art dry hydro-therapy body massage apparatus, comparable to that of FIG. 2.

In known prior art massage apparatus, the flange 32, and the edge margin of the user support surface 14 affixed thereto, are typically covered by a cushioned rectangular frame 36 corresponding in dimension and affixed to the upper flange 32 of the housing shell 20, as is depicted in cross-sectional view in FIG. 3. As will be seen and understood, the covering frame 36 typically comprises a main core body 38, commonly of wood, affixed at spaced locations along the sides and end of the housing to the outermost region of the flange 32 by through bolts 40 extending through the flange 32, the edge margins of the user support membrane sheet 34, and through an elongate torsion bar 42 adjacent the underside of the flange 32. An edge tab 44 extends downwardly from the outward edge of the flange 32 to provide an attachment surface by which enclosure panels 46 may be affixed, e.g., via hook and loop fastener elements 48, for outwardly enclosing the housing shell 20, the supporting frame 24 and operational components such as the motor and pump. The main core body 38 of the covering frame 36 is wrapped with a layer of cushioning foam 50 and covered by an upholstery material 52 to provide a comfortable and aesthetically pleasing finished appearance.

As described above, while the described construction of the covering frame 36 provides for secured sealing of the user support surface 14 to the housing shell 20, the built-up elevational thickness of the main core body 38 and its foam and upholstery covering 50, 52 above the user support membrane 34, adds to the difficulty for users to enter and exit the user support surface 14, which can be especially bothersome, difficult and even harmful to users undergoing massage treatment for bodily injuries or debilitating conditions.

The low profile surround structure of the present invention depicted in a preferred embodiment in FIG. 2 overcomes these problems with the prior art covering frame construction by substantially reducing the overall thickness of the finished covering structure over the flange 32 and the edge margins of the user support membrane sheet 34 thereby achieving a nominal elevational difference above the user support surface 14. Specifically, as described above, the perimeter flange 32 extends essentially horizontally outwardly from the opening 22 of the housing shell 20 and extends continuously uninterrupted perimetrically about the opening 22. The perimeter flange 32 of the housing shell 20 is planar except for a recess 54 for containing a seal element 56, for example in the form of a square O-ring. The edge margin of the user support membrane sheet 34 extends over the upwardly facing surface of the flange 32, including the recess 54, in direct face-abutting surface contact therewith beneath the O-ring seal element 56. An essentially planar clamp plate 58 is affixed in substantially parallel superposed facing relation to the perimeter flange 32 overlying the edge margin of the user support membrane sheet 34 and is secured in such disposition by a series of bolts 60 extending through the clamp plate 58, the membrane sheet margin, the flange 32 and a securing block 62 therebeneath at spacings along the lengthwise sides and widthwise ends of the housing shell 20. In this manner, the edge margin of the user support surface membrane sheet 34 is clamped and sealed relative to the housing shell 20.

A series of enclosure panels 64 are provided for outwardly enclosing the housing shell 20, the frame 14, and the operational components of the apparatus. Each enclosure panel 64 has an essentially planar mounting flange 66 and a skirt portion 68 extending angularly from the mounting flange 66. The mounting flange 66 is affixed in substantially parallel superposed facing relation to the clamp plate 58, e.g., via a hook and loop fastener assembly 70, to provide an aesthetically pleasing finished enclosure about the apparatus, while also permitting the enclosure panels 64 to be readily removed when needed, for example for servicing or repair of the apparatus. Advantageously, the overall structure of the assemblage of the flange 32, the edge margin of the user support membrane sheet 34, the clamp plate 58 and the mounting flange 66 of the enclosure panel 64 have a minimal collective thickness whereby the upper surface of the mounting flange 66 is disposed at only a nominal elevation above the user support surface 14 to provide a low profile surround thereabout. The actual dimensional elevation of the mounting flange 66 above the user support surface 14 may vary from apparatus to apparatus subject to the fundamental objective of positioning the flange 66 sufficiently close to the user support surface 14 to promote ease of entry and exit by a user to and from the user support surface over the flange without undue physical exertion or movements that may be difficult or harmful to an injured or otherwise impaired user. By way of example but without limitation, the elevation of the mounting flange above the user support surface is believed optimally to be on the order of approximately 0.75 inch or less, with some variation according to a particular apparatus structure.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

What is claimed is:

1. An apparatus for dry hydro-therapy body massage characterized by a low profile enclosure structure surrounding a user support surface at a nominal elevation thereabove, the apparatus comprising a housing structure having an outwardly facing opening, a user support surface sealably covering the opening, and a fluid spray arrangement interiorly within the housing structure for directing a fluid stream at the user support surface for imparting a massaging effect through the support surface to the body of a user thereon, the housing structure having an essentially horizontal perimeter flange extending uninterrupted about the opening and an essentially planar clamp plate affixed in substantially parallel superposed facing relation to the perimeter flange for clamping therebetween of a continuous edge margin of the user support surface, and an enclosure panel having an essentially planar mounting flange affixed in substantially parallel superposed facing relation to the clamp plate and having a skirt portion extending from the mounting flange for outwardly enclosing the housing structure, wherein the mounting flange of the enclosure panel is disposed at a nominal elevation above the user support surface to form a low profile surround thereabout.

2. The apparatus for dry hydro-therapy body massage according to claim 1, wherein the user support surface is a generally horizontal bed surface on which the user may lay in a recumbent position.

3. The apparatus for dry hydro-therapy body massage according to claim 1, wherein the perimeter flange of the housing structure comprises a recess containing a seal element held therein by the clamping plate for sealably clamping the edge margin of the user support surface within the recess.

4. The apparatus for dry hydro-therapy body massage according to claim 1, further comprising a safety net secured to the housing structure immediately adjacent an inward side of the user support surface for weight bearing support of a user on the user support surface.

5. The apparatus for dry hydro-therapy body massage according to claim 1, further comprising a fastener arrangement physically securing the clamping plate to the perimeter flange of the housing structure.

6. The apparatus for dry hydro-therapy body massage according to claim 1, further comprising a hook and loop fastener assembly for affixing the mounting flange of the enclosure panel to the clamping plate.

7. The apparatus for dry hydro-therapy body massage according to claim 1, wherein the elevation of the mounting flange above the user support surface is sufficiently small to promote ease of entry and exit by a user to and from the user support surface over the flange without undue physical exertion or movements that may be difficult or harmful to an injured or impaired user.

8. The apparatus for dry hydro-therapy body massage according to claim 7, wherein the elevation of the mounting flange above the user support surface is on the order of approximately 0.75 inch or less.

9. An apparatus for dry hydro-therapy body massage characterized by a low profile structure adjacent a user support surface at a nominal spacing therefrom, the apparatus comprising a housing structure having an outwardly facing opening, a user support surface covering the opening, and a fluid spray arrangement interiorly within the housing structure for directing a fluid stream at the user support surface for imparting a massaging effect through the support surface to the body of a user thereon, the housing structure having an essentially planar flange extending adjacent the opening and an essentially planar clamp plate affixed in substantially parallel superposed facing relation to the perimeter flange for clamping therebetween of an edge margin of the user support surface, and a covering panel having an essentially planar mounting surface affixed in substantially parallel facing relation to the clamp plate for disposition at a nominal spacing from the user support surface.

10. The apparatus for dry hydro-therapy body massage according to claim 9, wherein the user support surface is a generally horizontal bed surface on which the user may lay in a recumbent position.

11. The apparatus for dry hydro-therapy body massage according to claim 9, wherein the flange of the housing structure comprises a recess containing a seal element held therein by the clamping plate for sealably clamping the edge margin of the user support surface within the recess.

12. The apparatus for dry hydro-therapy body massage according to claim 9, further comprising a safety net secured to the housing structure immediately adjacent an inward side of the user support surface for weight bearing support of a user on the user support surface.

13. The apparatus for dry hydro-therapy body massage according to claim 9, further comprising a fastener arrangement physically securing the clamping plate to the flange of the housing structure.

14. The apparatus for dry hydro-therapy body massage according to claim 9, further comprising a hook and loop fastener assembly for affixing the mounting flange of the enclosure panel to the clamping plate.

15. The apparatus for dry hydro-therapy body massage according to claim 9, wherein the elevation of the mounting flange above the user support surface is sufficiently small to promote ease of entry and exit by a user to and from the user support surface over the flange without undue physical exertion or movements that may be difficult or harmful to an injured or impaired user.

16. The apparatus for dry hydro-therapy body massage according to claim 15, wherein the elevation of the mounting flange above the user support surface is on the order of approximately 0.75 inch or less.

* * * * *